US007806394B2

(12) United States Patent
Wuerthner

(10) Patent No.: US 7,806,394 B2
(45) Date of Patent: Oct. 5, 2010

(54) AUTOMATIC WORKPIECE CLAMP AND SUPPORT

(76) Inventor: Matthew Wayne Wuerthner, 1357 Meyers Station Rd., Odenton, MD (US) 21113

( * ) Notice: Subject to any disclaimer, the term of this patent is extended or adjusted under 35 U.S.C. 154(b) by 0 days.

(21) Appl. No.: 12/015,954

(22) Filed: Jan. 17, 2008

(65) Prior Publication Data

US 2009/0184450 A1 Jul. 23, 2009

(51) Int. Cl.
*B25B 5/06* (2006.01)

(52) U.S. Cl. ..... 269/133; 269/254 CS; 269/254 R; 269/157; 269/905; 269/285

(58) Field of Classification Search ..... 269/133, 269/905, 909, 254 R, 254 MW, 237, 260, 269/285, 254 CS, 157; 280/79.7, 47.131; 414/444, 450, 10, 11
See application file for complete search history.

(56) References Cited

U.S. PATENT DOCUMENTS

| | | | | |
|---|---|---|---|---|
| 2,605,795 | A * | 8/1952 | Tracy | 269/133 |
| 6,663,123 | B1 * | 12/2003 | Kovacs | 280/79.7 |
| 2009/0184450 | A1 * | 7/2009 | Wuerthner | 269/133 |

* cited by examiner

*Primary Examiner*—Lee D Wilson
(74) *Attorney, Agent, or Firm*—James A. Kodak

(57) ABSTRACT

An automatic clamping device is disclosed for holding planar workpieces such as: doors, windows, panels, plasterboard, etc. The planar workpiece is held in an upright position by clamping bars actuated by the weight of the workpiece. Automatic clamping is accomplished by placing the workpiece through a slot at the top of the clamping device and lowering it onto a flexible strap connected to movable bars which, under the weight of the workpiece, move laterally towards and clamp the workpiece. The workpiece is released by simply lifting it up through the slot and an elastic member will automatically return the bars to an open position.

8 Claims, 3 Drawing Sheets

AUTOMATIC WORKPIECE CLAMP AND SUPPORT

BACKGROUND OF THE INVENTION

1. Field of the Invention

The invention relates generally to the quick engagement of planar workpieces in a steady upright position while work is done upon them and more specifically to the quick engagement and disengagement of a door, window, or plasterboard as such an objects is cut, trimmed, painted or prepared for lock and hinge installation.

2. Description of the Prior Art

There are numerous devices in the field of door holders and clamps dating back to the nineteenth century. These devices can be separated into two basic mechanisms. One type of mechanism uses a brace or a plurality of braces to hold the door or other planar piece on edge and the positioning of the braces is secured by either a wedge (U.S. Pat. No. 7,125,009), a screw (e.g. U.S. Pat. No. 6,886,821), a pin (e.g. U.S. Pat. No. 5,294,099), a retractable spring (e.g. U.S. Pat. No. 4,391,437), or fixed ridges (e.g. U.S. Pat. No. 2,621,687). Another type uses the weight of the workpiece itself in order to actuate stabilizing braces or jaws. U.S. Pat. Nos. 5,513,836, 4,799,658, 4,270,741, 2,971,548 and 2,605,795 all disclose a holding mechanism actuated by the weight of the workpiece.

Although this latter type of mechanism permits automatic clamping, all such devices employing it to date are composed of numerous parts and contain several points of friction between the receiver and the clamping mechanism. There is thus a need in the art for a simple, inexpensive and maintenance free way to quickly secure planar workpieces.

SUMMARY OF THE INVENTION

The present invention serves the purpose of automatically clamping a planar workpiece in an upright position and enabling a quick a release by simply lifting the workpiece.

The invention has an open slot at the top through which a planar workpiece is inserted. As the workpiece is lowered, it engages a flexible strap which is attached on either end to rigid bars with a substantially square cross-section. These rigid bars serve as clamping means. The weight of the workpiece forces the clamping bars together, overcoming the force of an elastic member that keeps the bars separate when no workpiece is engaged. The elastic member keeps the clamping bars separated in an open position via rotating levers that are attached to the elastic member, the frame and the top portions of the clamping bars. Attached to the lower portions of the clamping bars there are pivoting arms which attach to the frame portion of the invention. As these pivoting arms are rigid with respect to any horizontal movement perpendicular to the clamping motion, they serve as an effective means of preventing the clamping bars from swinging while engaged.

All parts comprising the top of the invention are beveled so that it may be used to hold the broad side of a workpiece at an acute angle with respect to the ground. Upon the placement of a sufficiently heavy workpiece, such as a door, on top of the invention, the weight of the workpiece forces the top levers down into a position that is parallel to the ground. All top portions are beveled so that when the levers swing to this parallel position they form a continuous smooth angle allowing for stable support of a door when laid at a sufficiently acute angle with respect to the ground.

To prevent the invention from falling over while in use, it is equipped with a rotating leg piece that swings out laterally on both sides of the frame base.

BRIEF DESCRIPTION OF THE DRAWINGS

An embodiment of the present invention will now be described by way of an example and with reference to the accompanying drawings, in which.

DETAILED DESCRIPTION

Figure 1:
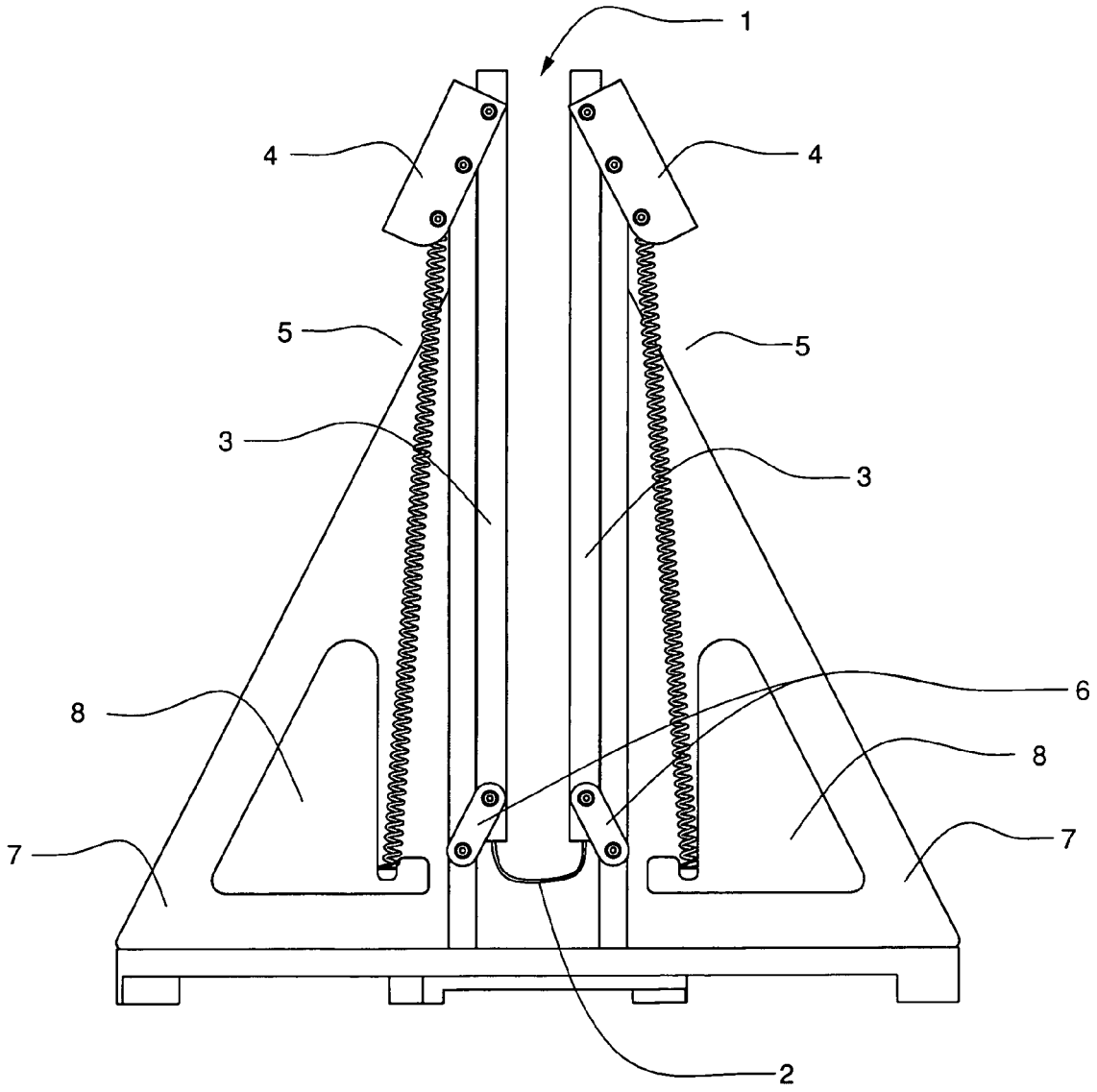
FIG. 1 illustrates a front view of the clamp/support embodying the present invention in a state of non-use.

Before engagement with a workpiece, as shown in FIG. 1, the clamping bars 3 are pressed against the frame 7 by elastic members 5 which are connected to the clamping bars 3 via rotating levers 4 that are secured to the frame 7. The point at which the levers 4 join the frame 7 defines the pivot point for the levers. Before engagement, there is a gap 1 between the clamping bars 3 into which a door, panel, window, plasterboard, or other workpiece can be inserted. The overall shape of the frame 7 is generally triangular and gap 1 essentially creates two symmetrical triangles on either side of the gap. Assuming the invention is composed of a sufficiently sturdy material such as wood, the centers of these two symmetrical triangles may be cut out 8 while preserving physical integrity. These cut outs 8 serve not only to lessen the overall weight of the invention, but also provide a simple and effective means for gripping it.

The design of the clamping bars is critical to the utility of this invention. The preferred embodiment employs elongated bars with a square cross section. Since it is envisioned that most workpieces will be made of wood, friction will be maximized if the clamping bars are also made of wood. In the alternative, the side of the bar that engages the workpiece can be coated or covered with a tacky surface specifically designed for gripping materials made of wood.

Figure 2:
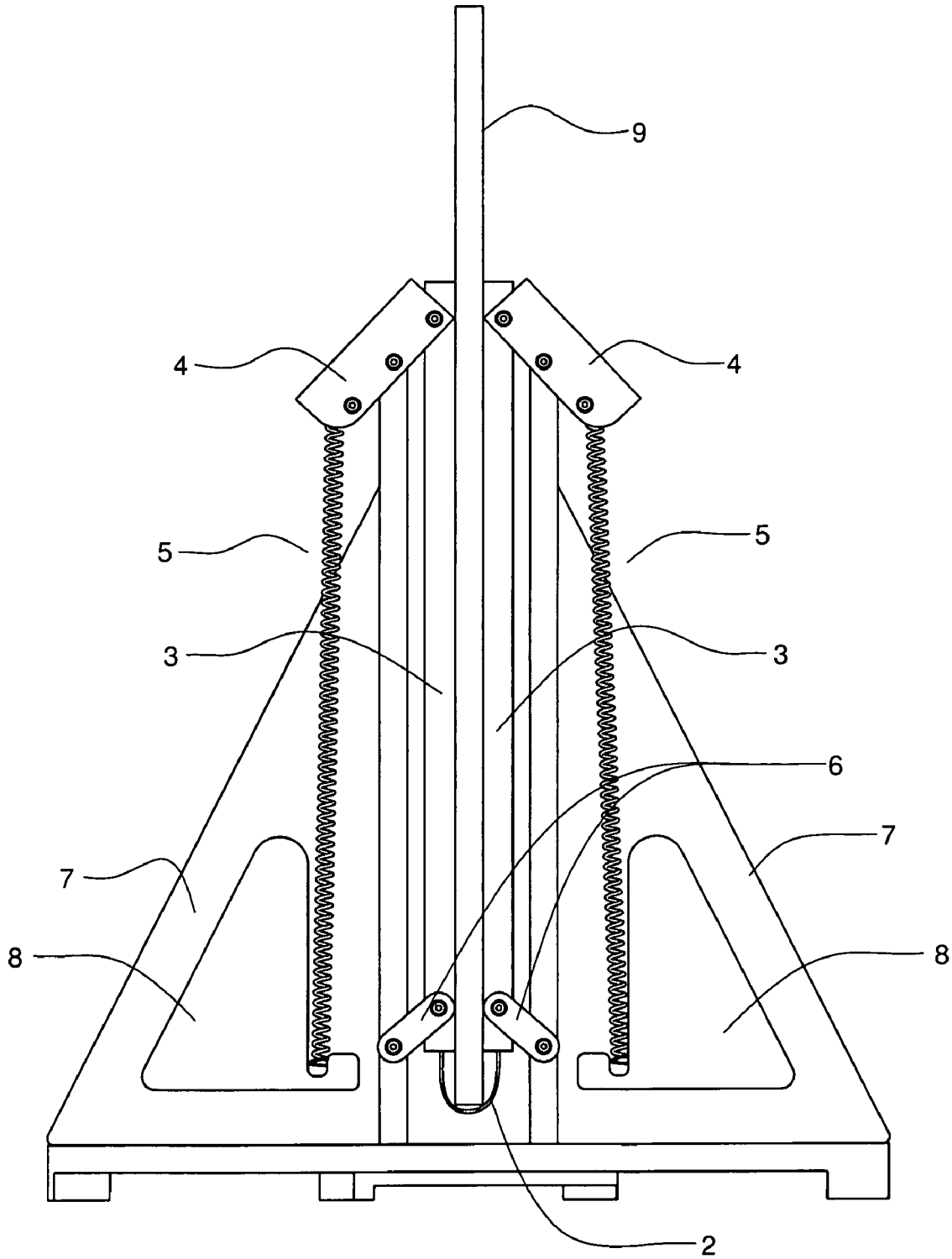
FIG. 2 illustrates a top view of a planar workpiece held upright by the clamp/support of FIG. 1.

When the clamp is engaged with a workpiece 9, as shown in FIG. 2, the weight of the workpiece presses down upon the catch strap 2. The catch strap 2, with ends attached to the bottom of the clamping bars 3, forces the clamping bars 3 inward, overcoming the resistance of the elastic members 5, until the clamping bars 3 engage the workpiece 9. Pivoting arms 6, mounted near the bottom of the clamping bars 3, prevent any swinging motion perpendicular to the frame 7. The pivoting arms 6 are attached at one end to the clamping bars 3 and to the frame 7 at the other end.

Although the catch strap can be attached to the bottom of the clamping bars in any number of ways, it is preferable that the strap form an eye at both ends that is suitable for wrapping around a dowel. The bottoms of the clamping bars are then mortised to receive the strap and dowel. To secure the joint from any slippage, glue should be applied to both the dowel and the strap before sliding into the mortise.

Figure 3:
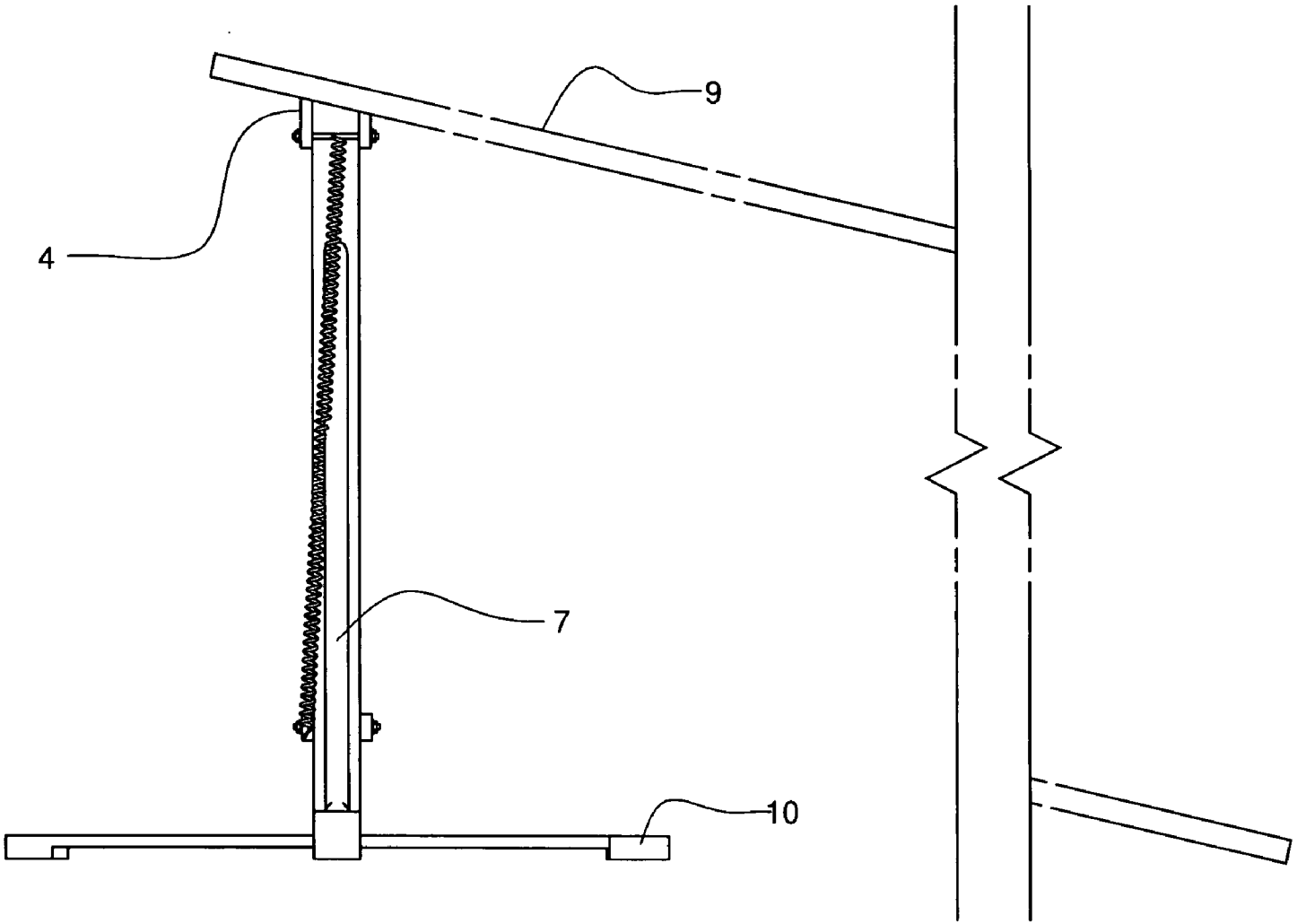
FIG. 3 illustrates a side view of a planar workpiece kept at an angle with the clamp/support of FIG. 1.

The levers 4 at the top of the invention can serve as a means of stabilizing a planar workpiece lain upon its broadside, FIG. 3. When a workpiece 9 is placed upon the top, the levers 4 will flatten under its weight. The tops of the levers 4 are beveled at an appropriate angle so as to maximize surface contact with the workpiece 9, preferably between 10 and 20 degrees. The preferred angle is calculated based upon a few practical assumptions: (1) the work piece will most often be a door, (2) a door will lay lengthwise with one end on the floor and the other end on or just beyond the support, and (3) the height of the average door is approximately 2 meters.

Whether the invention is being employed in its clamp or merely a support capacity, it is necessary to prevent it from falling down in a direction parallel to the length of the work piece 9, FIG. 3. This lateral support will be provided by a leg piece 10. In order to simplify the storage of the workpiece clamp and support, it is preferable for the leg piece 10 to be in line with the base of frame 7 when not in use and then rotate away from the base when the clamp or support is put to use. This can be accomplished by mounting the center of the leg piece 10 with the center of the frame 7, but in such a way as to allow rotation of the leg piece, e.g., a shoulder bolt mount.

I claim:

1. A clamping device for holding generally planar workpieces in an upright position comprising:

a symmetrical frame with a gap accessible from the top and sides of said frame for the insertion of said workpieces;

two bars with a generally square cross-section that serve to clamp a planar workpiece such as a door, panel, window, or plasterboard in an upright position;

at least one of said bars are moveable perpendicularly to the plane of said workpiece;

the force of clamping is generated by the weight of said workpiece;

the weight of said workpiece generates clamping via utilization of a catch strap which is attached to the bottom of said bars;

an elastic member or plurality thereof generates the force necessary to hold said bars apart via a pivoting lever when said flexible catch strap is not engaged with said workpiece; and said pivoting lever is attached to the top of said clamping bar on the end proximal to the workpiece and attached to said elastic member on the end distal to the workpiece with the pivot point in the middle of said lever and there forming an attachment with said frame.

2. A clamping device as defined in claim 1 wherein said bars are stabilized by arms that are attached at one end near the bottom of said bars and to said frame at the other end and these attachments are rigid in the direction parallel to the plane of said workpiece but allow free rotation in the plane perpendicular to said workpiece.

3. A clamping device as defined in claim 1 wherein the device is stabilized through the use of a leg piece which can be rotated out from underneath the frame.

4. A clamping device as defined in claim 1 wherein the top of the frame and the pivoting levers are beveled between 10 and 20 degrees.

5. A clamping device for holding generally planar workpieces in an upright position comprising:

a symmetrical frame with a gap accessible from the top and sides of said frame for the insertion of said workpieces;

two bars with a generally square cross-section that serve to clamp a planar workpiece such as a door, panel, window, or plasterboard in an upright position;

at least one of said bars are moveable perpendicularly to the plane of said workpiece;

the force of clamping is generated by the weight of said workpiece;

the weight of said workpiece generates clamping via utilization of a catch strap which is attached to the bottom of said bars;

an elastic member or plurality thereof generates the force necessary to hold said bars apart via a pivoting lever when said flexible catch strap is not engaged with said workpiece;

as said workpiece is lowered into said gap and engages said flexible strap, said flexible strap will form the nadir of a substantially V shaped configuration between said bars and as said workpiece is released, the weight of said workpiece overcomes the tension in said spring or elastic means, said lever pivots, and said V shape closes as said bars fully engage the plane of said workpiece; and pivoting arms connecting the bottom of said bars to said frame for stabilization of motion parallel to the plane of the clamping force.

6. A clamping device as defined in claim 5 wherein said bars are stabilized by levers that are attached at one end near the bottom of said bars and to said frame at the other end and these attachments are rigid in the direction parallel to the plane of said workpiece but allow free rotation in the plane perpendicular to said workpiece.

7. A clamping device as defined in claim 5 wherein the device is stabilized through the use of a leg piece which can be rotated out from underneath the frame.

8. A clamping device as defined in claim 5 wherein the top of the frame and the pivoting levers are beveled between 10 and 20 degrees.

* * * * *